US010213028B2

(12) United States Patent
Julien

(10) Patent No.: US 10,213,028 B2
(45) Date of Patent: Feb. 26, 2019

(54) BEACH COMPLETE

(71) Applicant: Sherly Telcide Julien, Hollywood, FL (US)

(72) Inventor: Sherly Telcide Julien, Hollywood, FL (US)

( * ) Notice: Subject to any disclaimer, the term of this patent is extended or adjusted under 35 U.S.C. 154(b) by 0 days.

(21) Appl. No.: 15/167,993

(22) Filed: May 28, 2016

(65) Prior Publication Data

US 2017/0181550 A1 Jun. 29, 2017

Related U.S. Application Data

(60) Provisional application No. 62/230,322, filed on Jun. 3, 2015.

(51) Int. Cl.

| | |
|---|---|
| ***A47G 9/06*** | (2006.01) |
| ***A47C 21/00*** | (2006.01) |
| ***A47C 19/22*** | (2006.01) |
| ***A47C 27/08*** | (2006.01) |
| ***A47C 17/64*** | (2006.01) |
| ***A47C 29/00*** | (2006.01) |
| ***A45B 19/02*** | (2006.01) |

(52) U.S. Cl.

CPC ..... *A47C 19/22* (2013.01); *A45B 19/02* (2013.01); *A47C 17/64* (2013.01); *A47C 27/081* (2013.01); *A47C 29/003* (2013.01); *A45B 2200/1009* (2013.01); *A47C 21/00* (2013.01); *A47G 9/062* (2013.01)

(58) Field of Classification Search

CPC ..... A47G 9/02; A47G 9/062; A47C 21/00
USPC ..... 5/417–420, 507.1, 503.1, 658
See application file for complete search history.

(56) References Cited

U.S. PATENT DOCUMENTS

| | | | | | |
|---|---|---|---|---|---|
| 3,969,776 | A * | 7/1976 | Gildea | A47K 3/02 | 4/546 |
| 4,248,255 | A * | 2/1981 | Arrowsmith | A45B 23/00 | 135/121 |
| 4,681,195 | A * | 7/1987 | Trahan | A45B 23/00 | 135/117 |
| 5,022,107 | A * | 6/1991 | Knotts | A47C 1/146 | 5/419 |
| 5,651,152 | A * | 7/1997 | Ritchie | A47C 21/00 | 294/143 |
| 5,879,377 | A * | 3/1999 | Mullins | A61N 5/0614 | 5/421 |
| 6,061,850 | A * | 5/2000 | Roper, III | A45B 11/00 | 248/519 |
| 6,148,459 | A * | 11/2000 | Verhulst | A47C 21/00 | 5/110 |
| 6,233,765 | B1 * | 5/2001 | Verhulst | A47C 21/00 | 5/110 |
| 6,347,419 | B1 * | 2/2002 | Kurtz | A47C 21/00 | 5/503.1 |
| 6,704,952 | B2 * | 3/2004 | Kurtz | A47C 17/86 | 312/237 |

(Continued)

FOREIGN PATENT DOCUMENTS

| | | | | |
|---|---|---|---|---|
| FR | 2589702 A1 * | 5/1987 | ..... | A45B 11/00 |

*Primary Examiner* — Robert G Santos

(57) ABSTRACT

An inflatable beach complete bed unit containing a mattress, a base, a pillow, a side tray, a parasol and a long rectangular hollow shape on a side of the bed unit. A complete unit to use at the beach so one can enjoy the moment neatly and without misplacing or losing any personal items and other beach essentials in the sand.

6 Claims, 4 Drawing Sheets

(56) References Cited

U.S. PATENT DOCUMENTS

| | | | | |
|---|---|---|---|---|
| 7,325,264 | B2 * | 2/2008 | Holmes | A47C 17/82 5/114 |
| 8,185,987 | B2 * | 5/2012 | Keehfus | A47C 21/00 248/311.2 |
| 8,572,784 | B2 * | 11/2013 | Keehfus | A47C 21/00 248/311.2 |
| D702,963 | S * | 4/2014 | Chavis | D6/513 |
| 9,095,222 | B2 * | 8/2015 | Asaf | A47C 21/00 |
| 9,924,805 | B2 * | 3/2018 | Cass | A47C 31/00 |
| 2003/0159214 | A1 * | 8/2003 | Kurtz | A47C 17/86 5/503.1 |
| 2004/0261175 | A1 * | 12/2004 | May | A47C 7/62 5/503.1 |
| 2007/0204892 | A1 * | 9/2007 | Roper, III | A45B 9/02 135/16 |
| 2007/0277316 | A1 * | 12/2007 | Holmes | A47C 17/82 5/503.1 |
| 2011/0277239 | A1 * | 11/2011 | Keehfus | A47C 21/00 5/503.1 |
| 2012/0211622 | A1 * | 8/2012 | Keehfus | A47C 21/00 248/274.1 |
| 2013/0305451 | A1 * | 11/2013 | Asaf | A47C 21/00 5/503.1 |
| 2016/0242564 | A1 * | 8/2016 | Cass | A47C 31/00 |
| 2017/0181550 | A1 * | 6/2017 | Julien | A47C 19/22 |
| 2018/0035817 | A1 * | 2/2018 | Wheat | A47C 7/62 |
| 2018/0249839 | A1 * | 9/2018 | Cammack | A47C 21/00 |
| 2018/0271301 | A1 * | 9/2018 | Cass | A47C 31/00 |

* cited by examiner

BEACH COMPLETE

BACKGROUND

Traditional beach towels, chairs and blankets designed to provide users with enhanced comfort while spending the day at the beach. These elements are provided for people to enjoy their time there but, their functions do not answer the need of the users. In particular, a person can easily lose his/her beach essentials, such as books, electronic devices, drinks, and sandals in the sand when using them. Those beach elements provide some comfort but are not always sufficient.

SUMMARY

By having the beach complete unit a user would reduce the amount of sand on an individual's body and that would be transported upon clothing and towels, in addition various items included sandals books and other beach essentials could be conveniently house in the inflatable tray and cubby.

PRODUCT DESCRIPTION

Figure 1:
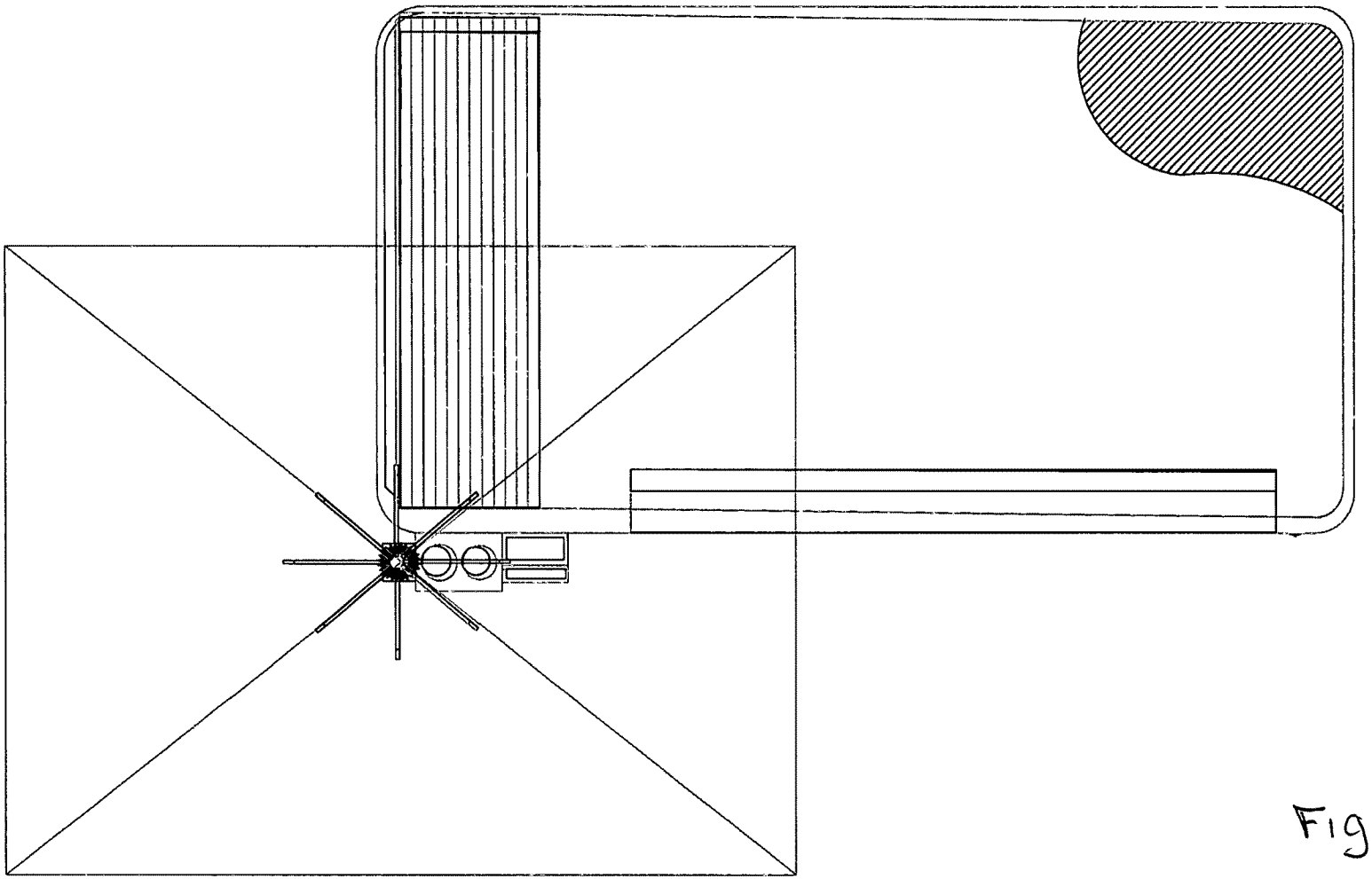
FIG. 1 Drawing shows the top view of the unit.
Figure 2:
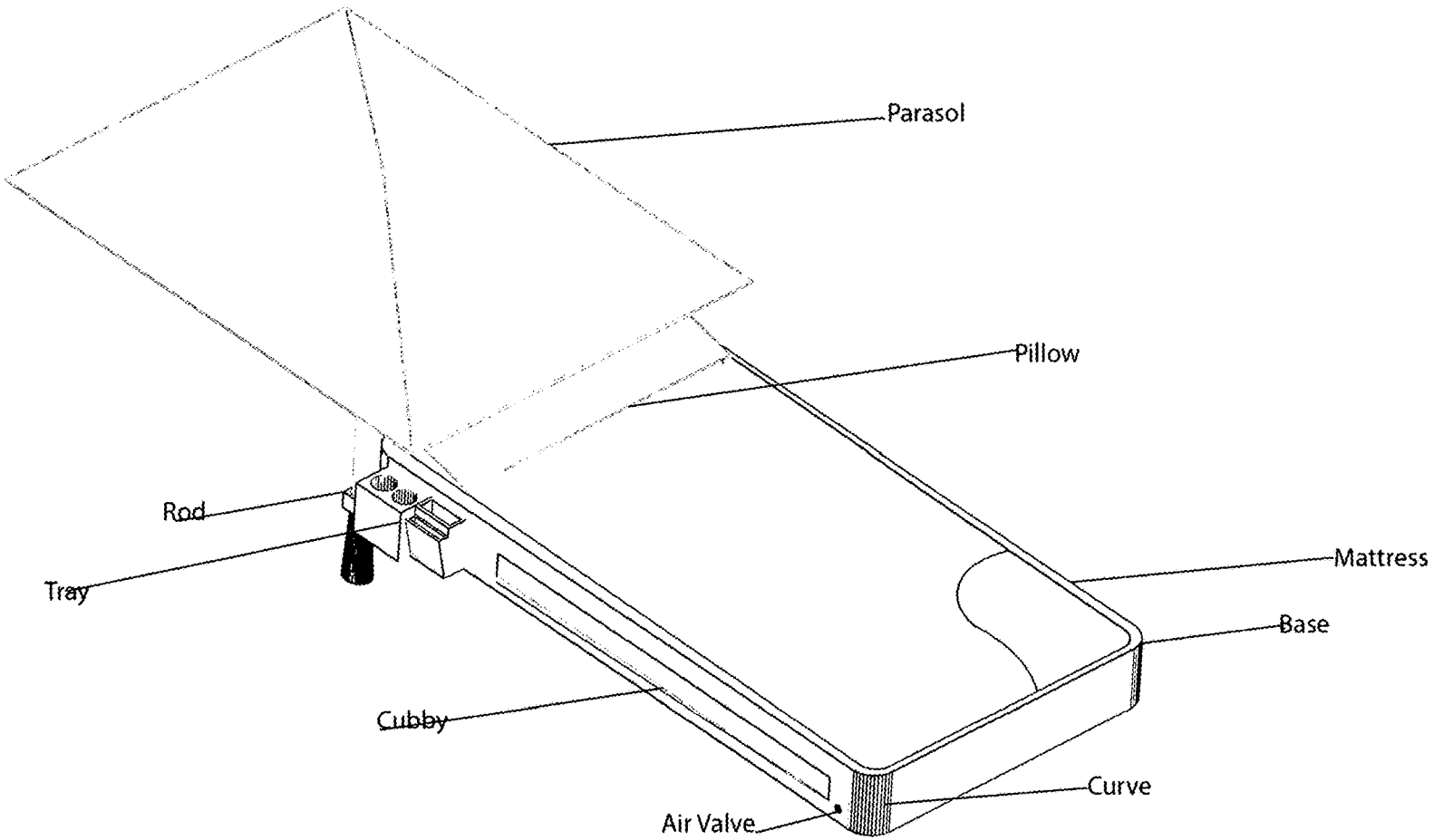
FIG. 2 Drawing shows the elements name of the unit.
Figure 3:
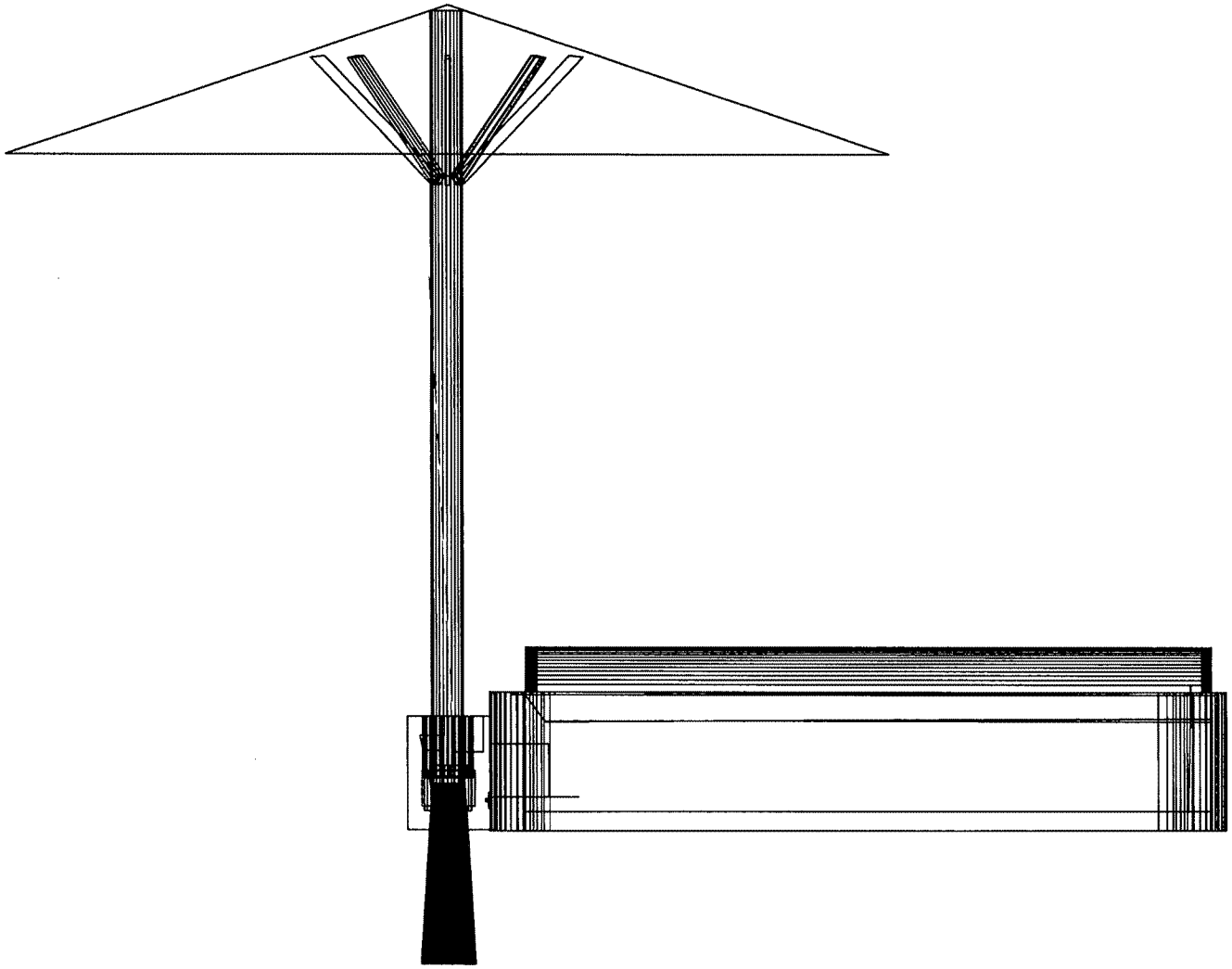
FIG. 3 Drawing shows the distribution of the tray in the unit.
Figure 4:
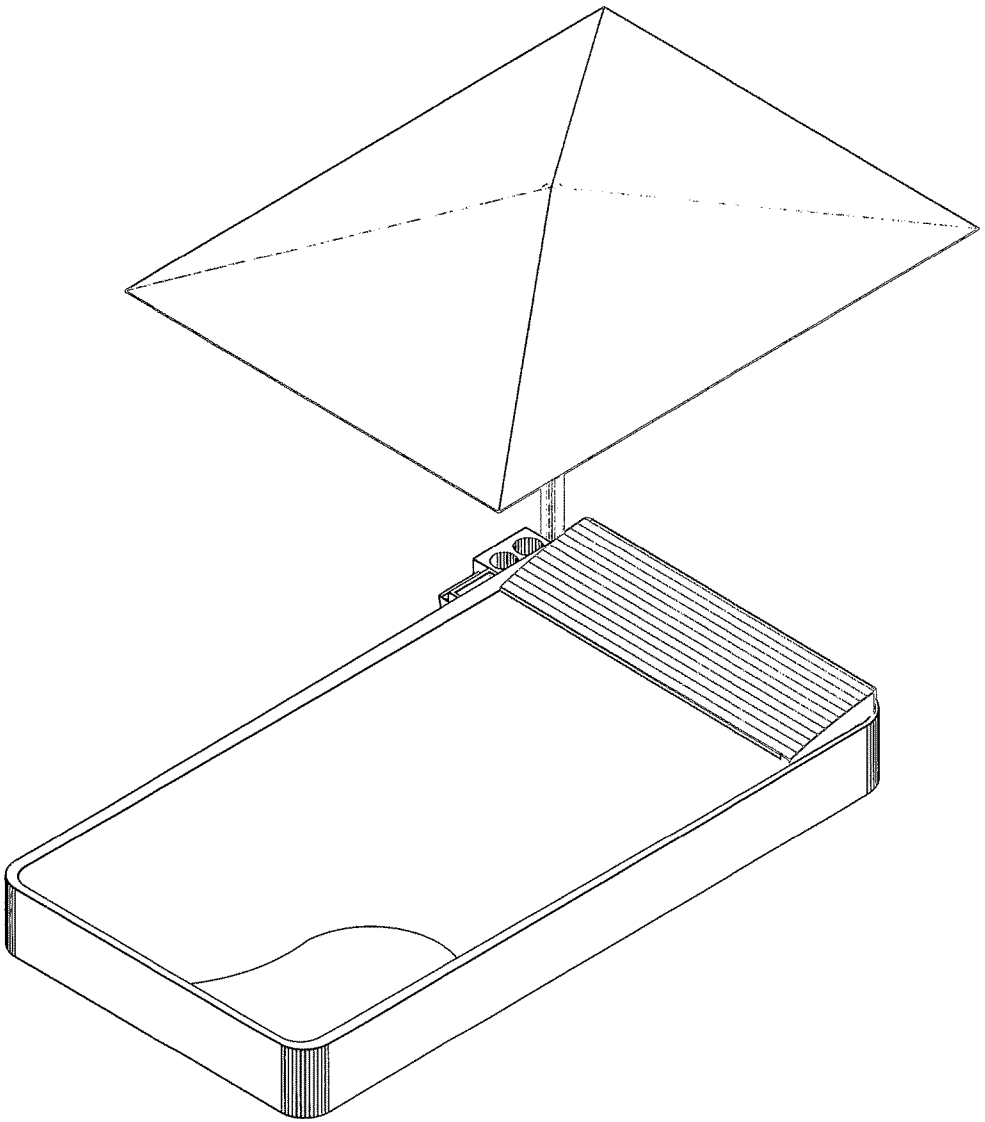
FIG. 4 Drawing shows a rendering view of the unit.

The "BEACH COMPLETE" will consist of a rectangular inflatable unit containing all in one mattress, base, pillow, tray, and parasol.

A mattress that will measure 80 inches long by 39 inches wide could contain a waterproof easy clean fabric cover which will be produced in a nature green color.

The attached base will be produced in a beige sand color from a firm heat-stamped plastic such as nylon or vinyl. To the side of the base an inflated tray in disposed that would conveniently store drinks, books and other beach necessities. the right side of the mattress base unit will also include a cubby where one can place their beach sandals without losing them in the sand.

The beach complete will also accompanied with a parasol that would provide protection from the sun; when desired, the rod for the parasol will be inserted in its place located to the right top corner of the unit next to the tray.

The whole unit could be inflated using a manual pump which will not be included in the packaging.

"BEACH COMPLETE" would fulfill the need for a more comfortable surface upon which to rest at the beach. The appealing features of "BEACH COMPLETE" would provide the individual with a relaxed day at the beach. The unit would elevate users from the surface of the beach. Thus, the designs of the "BEACH COMPLETE" would reduce the amount of sand upon the individual's body and that would be transported upon clothing and towels. In addition, various items including sandals, drinks, books, and other beach essentials could be conveniently housed within an inflatable tray and cubby, and they would not be lost in and coated with sand. The "BEACH COMPLETE" could be accompanied by a parasol that would provide protection from rays of the sun, when desired. I envision soft green and sand colors of this product bringing calmness to the user's soul. The use of this product could increase the sunbather's comfort and enjoyment of the leisure time activity.

The invention claimed is:

1. A rectangular inflatable bed unit containing a mattress having a pair of opposed ends and a top surface, a base supporting the mattress and having a bottom surface, a pillow located at one end of the mattress and on the top surface of the mattress, a side tray having a bottom surface substantially coplanar with the bottom surface of the base, a parasol secured to and extending below the bottom surface of the side tray and a long rectangular cubby having a bottom surface substantially coplanar with the respective bottom surfaces of the base and the side tray.

2. A rectangular inflatable bed unit according to claim 1, wherein the bed unit measures 80 inches long by 39 inches wide with an indent formed half an inch in the base.

3. A rectangular inflatable bed unit according to claim 2, wherein the mattress is waterproof with a soft nature green color and an easy to clean fabric, the base protrudes 1 inch past the mattress with a beige sand color produced from a firm, heart-stamped plastic with curved edges, and an inflation valve for the mattress is located at the right side bottom corner of the base.

4. A rectangular inflatable bed unit according to claim 1, wherein the side tray comprises three dividing pieces incorporated therein.

5. A rectangular inflatable bed unit according to claim 4, wherein each of the three dividing pieces contains a hollow shape and is disposed along a top edge of the bed unit.

6. A rectangular inflatable bed unit according to claim 1, further comprising a single circular hollow shape formed in the base to accommodate the parasol, two circular hollow shapes in a center of the side tray are for accommodating cups or bottles and, two rectangular shapes formed in the side tray are for accommodating books.

* * * * *